US008286312B2

(12) United States Patent
Paik

(10) Patent No.: US 8,286,312 B2
(45) Date of Patent: Oct. 16, 2012

(54) BUCKLE

(76) Inventor: Jisook Paik, Seoul (KR)

( * ) Notice: Subject to any disclaimer, the term of this patent is extended or adjusted under 35 U.S.C. 154(b) by 597 days.

(21) Appl. No.: 12/507,040

(22) Filed: Jul. 21, 2009

(65) Prior Publication Data

US 2010/0293763 A1 Nov. 25, 2010

(30) Foreign Application Priority Data

May 23, 2009 (KR) ..... 10-2009-0045218

(51) Int. Cl.
*A44B 11/25* (2006.01)

(52) U.S. Cl. ..... 24/614; 24/625; 24/615

(58) Field of Classification Search ..... 24/614, 24/615, 625

See application file for complete search history.

(56) References Cited

U.S. PATENT DOCUMENTS 5,465,472 A * 11/1995 Matoba ..... 24/625
5,507,076 A * 4/1996 Anscher ..... 24/625
6,148,486 A * 11/2000 Uehara et al. ..... 24/614
6,571,433 B2 * 6/2003 Uehara et al. ..... 24/614
6,728,999 B2 * 5/2004 Murai et al. ..... 24/615
7,650,676 B2 * 1/2010 Saitsu ..... 24/615
2008/0178438 A1 * 7/2008 Yoshie et al. ..... 24/615

* cited by examiner

*Primary Examiner* — Robert J Sandy
(74) *Attorney, Agent, or Firm* — Kile Park Goekjian Reed & McManus PLLC

(57) ABSTRACT

A buckle has plug and socket members which are detachably coupled to each other. The plug member having a base part, a pair of lock arms which project from the base part to be elastically coupled to the socket member, a guide rod which projects from the base part between the pair of lock arms, and bridges which extend from the base part inside the pair of lock arms and are connected to distal ends or middle portions of inner surfaces of the lock arms. The socket member have a chamber which is defined by an upper plate, a lower plate and sidewalls connecting the upper and lower plates and is open at a distal end thereof to receive the pair of lock arms and the guide rod, and engagement parts which are formed outside the chamber to allow distal end portions of the lock arms to be engaged therewith.

11 Claims, 6 Drawing Sheets

BUCKLE

BACKGROUND OF THE INVENTION

1. Field of the Invention

The present invention relates to a buckle, and more particularly, to a buckle having a plug member and a socket member which are mounted to the free ends of belts or straps attached to various articles such as clothes, knapsacks and helmets and are detachably coupled to each other.

2. Description of the Related Art

In general, a buckle serves as a locker in which a plug member and a socket member are detachably coupled to each other to allow the length of a belt or a strap to be adjusted so as to fit the human body or fix a product. The buckle as a locker is formed of a plastic material so that the plug member and the socket member can be elastically coupled to each other.

FIG. 1 is a schematic exploded perspective view illustrating a conventional buckle. The buckle includes a plug member 10 and a socket member 20.

As shown in FIG. 1, the plug member 10 has a pair of lock arms 12 which project straight forward from a base part 11 constituting a body of the plug member 10 and possess a predetermined degree of elasticity. Locking parts are projectedly formed on the outer surfaces of the distal end portions of the respective lock arms 12. A guide rod 13 is formed between the lock arms 12 to extend straight forward from the base part 11. The socket member 20 defines a chamber 21 which is open at the distal end of the socket member 20, so that the plug member 10 can be received into the chamber 21. A pair, of openings 22 are oppositely defined on both sidewalls of the socket member 20 so that the locking parts of the lock arms 12 can be elastically engaged into the openings 22.

As a user inserts the plug member 10 through the distal entrance of the socket member 20 into the chamber 21, the outer surfaces of the pair of lock arms 12, which are formed on both sides of the plug member 10, slide on the inner surfaces of the sidewalls of the socket member 20 while being elastically bent inward. Then, as the locking parts formed on the distal end portions of the lock arms 12 are aligned with the pair of openings 22, the locking parts if the lock arms 12 are elastically engaged into the openings 22 so that the plug member 10 and the socket member 20 are completely coupled to each other.

Thereafter, when it is necessary to decouple the buckle, the locking parts of the lock arms 12 of the plug member 10, which are exposed through the openings 22 of the socket member 20, are pressed from both outsides such that the respective locking parts of the lock arms 12 are disengaged from the openings 22 of the socket member 20. Then, as the plug member 10 is pulled outside, the plug member 10 and the socket member 20 are decoupled from each other.

However, in the conventional buckle, in order to allow the locking parts of the lock arms 12 to be stably engaged into the openings 22 of the socket member 20, the elastic stiffness of the lock arms 12 is increased. Due to this fact, when the lock arms 12 are excessively bent outward, problems are caused in that the lock arms 12 are likely to be deformed or broken. Also, since the lock arms 12 can be bent outward by being hooked by an object or by mistake while in use, the lock arms 12 can be easily damaged by the erroneous manipulation.

Further, in the conventional buckle, foreign substances can be easily attached in the socket member 20 or around the lock arms 12, and it is difficult to remove the foreign substances. Due to this fact, difficulties exist in appropriately manipulating the buckle, and poor coupling of the plug member 10 and the socket member 20 can result.

A structure in which lock arms are connected to bridges so as to prevent the deformation of the lock arms has been disclosed in Korean Patent No. 10-0467922. The inner surfaces of the lock arms are connected to a guide rod by the bridges. Nevertheless, in this structure, while the excessive outward bending of the lock arms can be prevented, the elasticity of the lock arms is unduly limited in the lateral direction. Consequently, inconvenience is caused when coupling and decoupling a plug member and a socket member to and from each other, and elastic shock increases upon coupling the plug member and the socket member to each other.

Another structure in which lock arms are connected by a bridge so as to prevent the excessive outward bending of the lock arms has been disclosed in Korean Patent No. 10-0601259. In a construction of directly connecting the lock arms by the bridge, the bridge has a shape which surrounds the outer surface of a guide rod.

Nonetheless, even in this structure, since the elasticity of the lock arms is unduly limited in the lateral direction, inconvenience is caused when coupling and decoupling a plug member and a socket member to and from each other. Further, a problem is caused in that the function of the guide rod for guiding the smooth coupling of the plug member and the socket member is likely to be lost.

As a result, the conventional buckles suffer from defects in that it is inappropriate to prevent the excessive outward bending of the lock arms while maintaining the sufficient elasticity of the lock arms, foreign substances can be easily attached in the socket member, and it is difficult to remove the foreign substances.

SUMMARY OF THE INVENTION

Accordingly, the present invention has been made in an effort to solve the problems occurring in the related art, and an object of the present invention is to provide a buckle which can prevent lock arms from being deformed or broken due to excessive outward bending and can maintain the sufficient elasticity of the lock arms so that a plug member and a socket member can be easily coupled to and decoupled from each other.

Another object of the present invention is to provide a buckle which can prevent foreign substances from being easily attached therein and can easily remove foreign substances introduced therein.

Still another object of the present invention is to provide a buckle which can save a material so that the manufacturing cost can be reduced and can decrease the weight thereof so that a knapsack, a bag, etc. can be used lightly, while preventing lock arms from being deformed or broken due to excessive outward bending.

In order to achieve the above objects, according to one aspect of the present invention, there is provided a buckle including a plug member and a socket member which are detachably coupled to each other, the plug member having a base part, a pair of lock arms which project from the base part to be elastically coupled to the socket member, and a guide rod which projects from the base part between the lock arms, the socket member having a chamber which is defined by an upper plate, a lower plate and sidewalls connecting the upper and lower plates and is open at a distal end thereof to receive the lock arms and the guide rod, and engagement parts which are formed outside the chamber to allow distal end portions of the lock arms to be engaged therewith, wherein the plug member has bridges which extend from the base part inside the lock arms and are connected to portions on inner surfaces of the lock arms.

Accordingly, since the bridges are located in the same direction as the lock arms and support the lock arms with respect to the base part, the excessive outward bending of the lock arms is prevented, and the elasticity of the lock arms is not adversely influenced, whereby it is possible to provide a buckle which is convenient to perform coupling manipulation.

The bridges extend from the base part of the plug member and are connected to the distal ends or the middle portions on the inner surfaces of the respective lock arms. Preferably, the bridges are formed integrally with the plug member while having flexibility.

The bridges can define curved surfaces, or one or at least two bending portions are formed on each bridge so that the elasticity of the bridge itself can be enhanced.

Another characteristic of the present invention resides in that the guide rod of the plug member is formed between the lock arms to be shorter than the lock arms.

According to this fact, the distal ends of the lock arms, which are positioned on both sides of the guide rod, can be bent sufficiently toward each other, and the elasticity of the lock arms can be secured, whereby the coupling and decoupling manipulation of the buckle can be easily performed.

Still another characteristic of the present invention resides in that a space part is defined in a rear part of the socket member to communicate with the chamber defined in the socket member and has indents which are defined in the upper and lower plates so that the space part can be enlarged forward into the socket member.

As the length of the guide rod decreases, the space part defined in the rear part of the socket member can be enlarged correspondingly. Therefore, as the indents are defined, the volume of the socket member in which foreign substances are likely to be attached can be decreased, and the foreign substances attached in the socket member can be easily removed.

Preferably, the indents are defined in a shape which gradually decreases in the width thereof toward the center portion of the socket member. The indents can be defined to have the sectional shape of a 'V', 'U' or 'Y'.

A still further characteristic of the present invention resides in that the guide rod of the plug member extends from the base part to be shorter than the lock arms, a slot is defined from the distal end of the guide rod in the lengthwise direction of the guide rod, a guide rib to be fitted into the slot of the guide rod is formed in the chamber of the socket member in such a way as to connect the upper and lower plates, and a space part is defined in a rear part of the socket member to communicate with the chamber and has indents which are defined in the upper and lower plates so that the space part can be enlarged forward to a portion where the distal end of the guide rod is positioned.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENT

Figure 1:
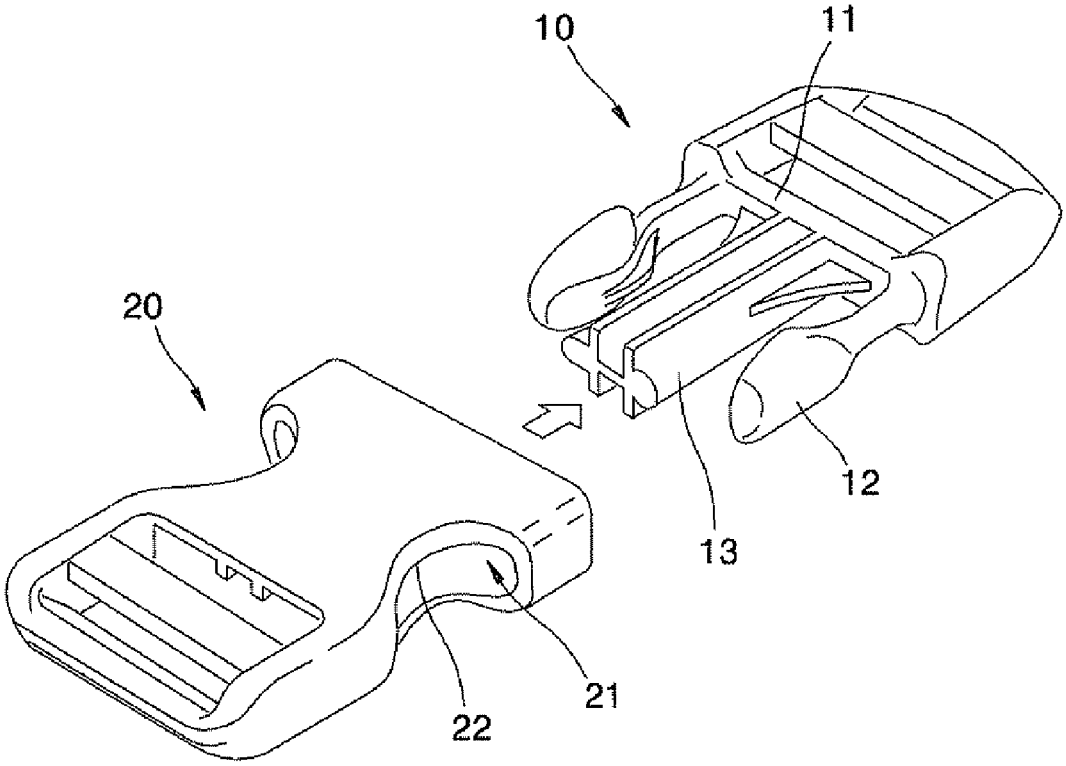
FIG. 1 PRIOR ART
FIG. 1 is a schematic exploded perspective view illustrating a conventional buckle.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
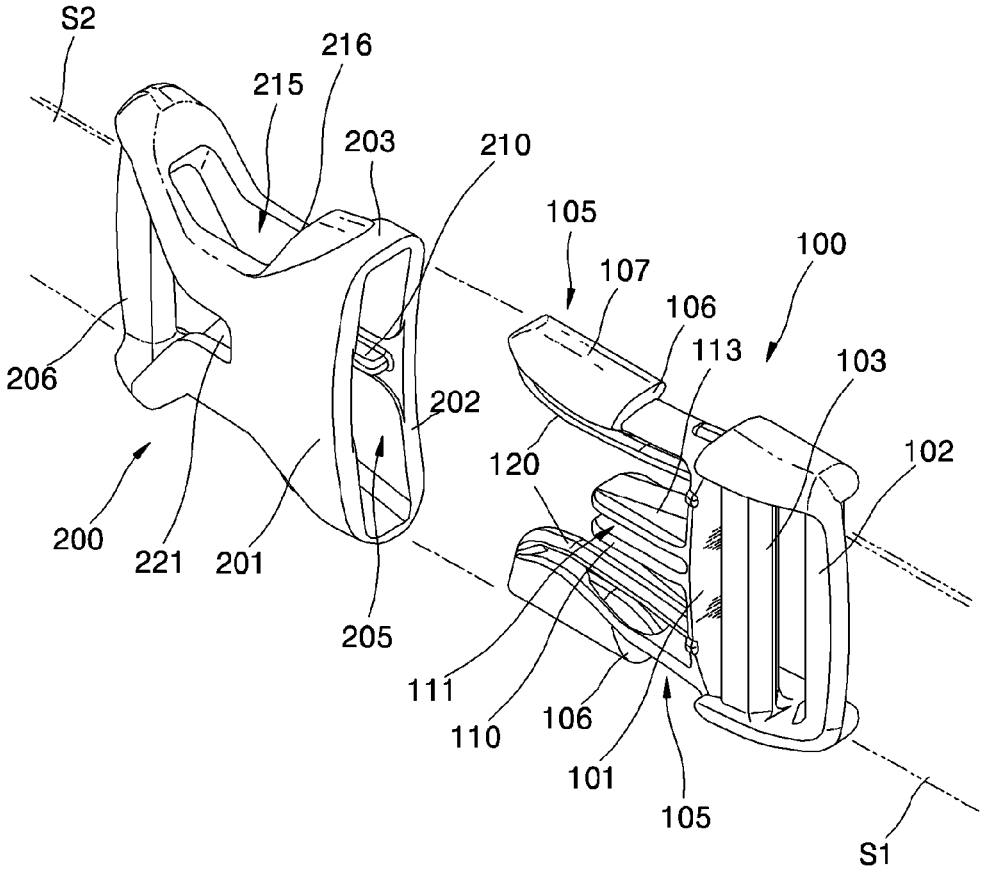
FIG. 2 is an exploded perspective view illustrating a buckle in accordance with an embodiment of the present invention.
Figure 3:
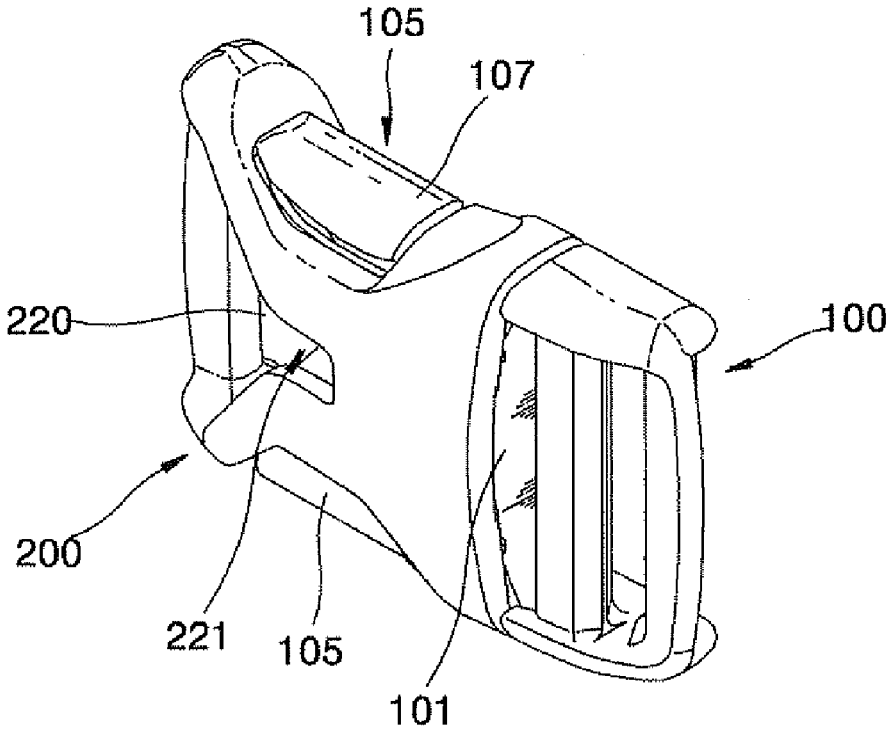
FIG. 3 is an assembled perspective view of the buckle shown in FIG. 2.
Figure 4:
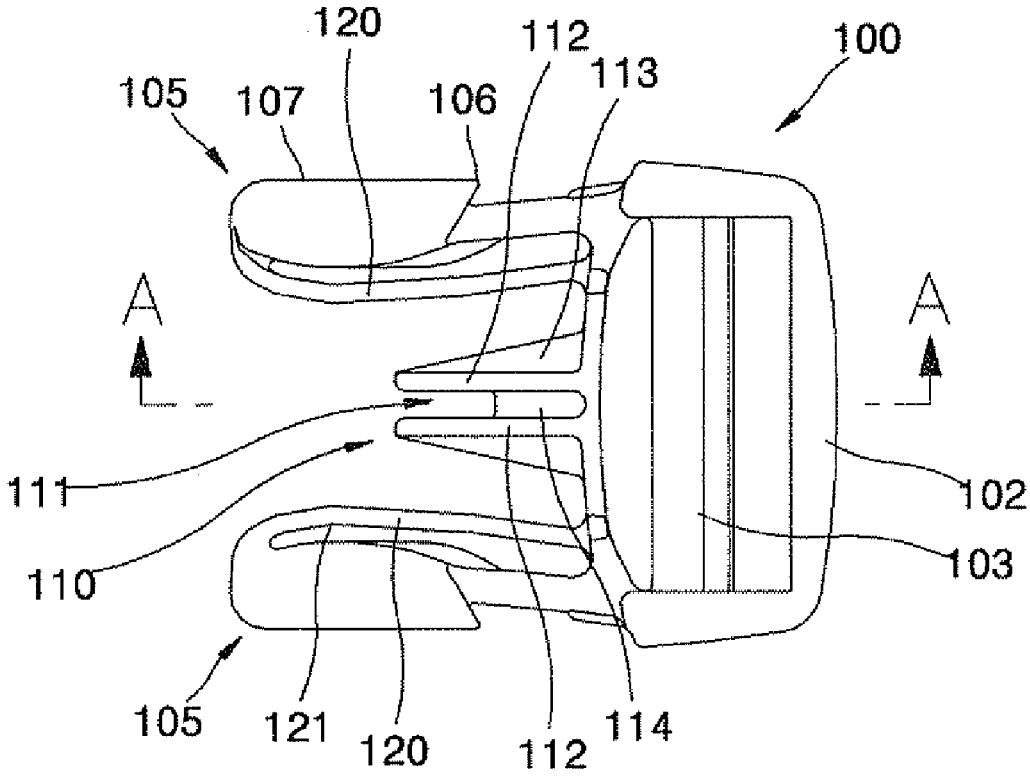
FIG. 4 is a plan view illustrating a plug member in accordance with the embodiment of the present invention.
Figure 5:
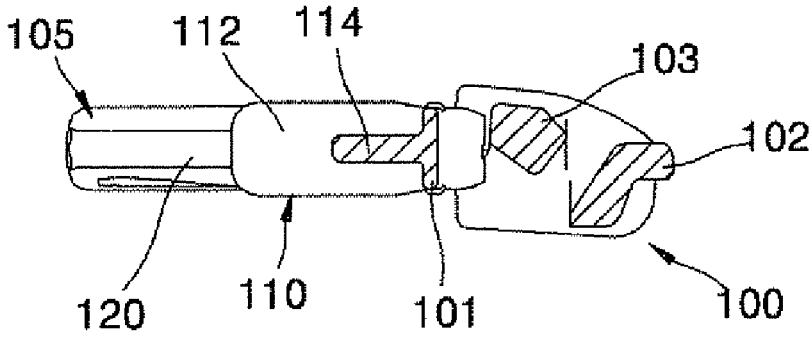
FIG. 5 is a sectional view taken along the line A-A of FIG. 4.
Figure 6:
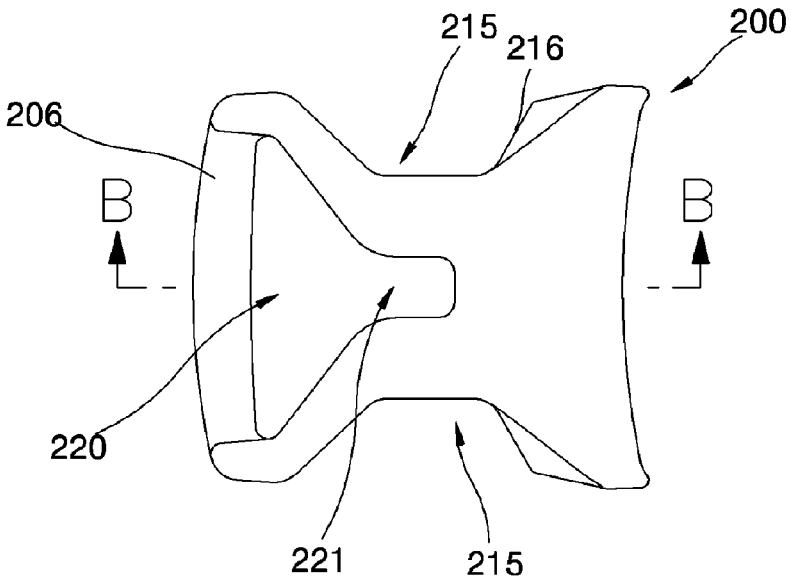
FIG. 6 is a plan view illustrating a socket member in accordance with the embodiment of the present invention.
Figure 7:
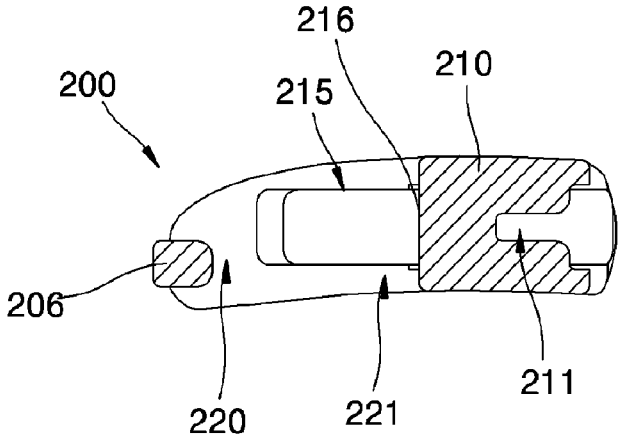
FIG. 7 is a sectional view taken along the line B-B of FIG. 6.
Figure 8:
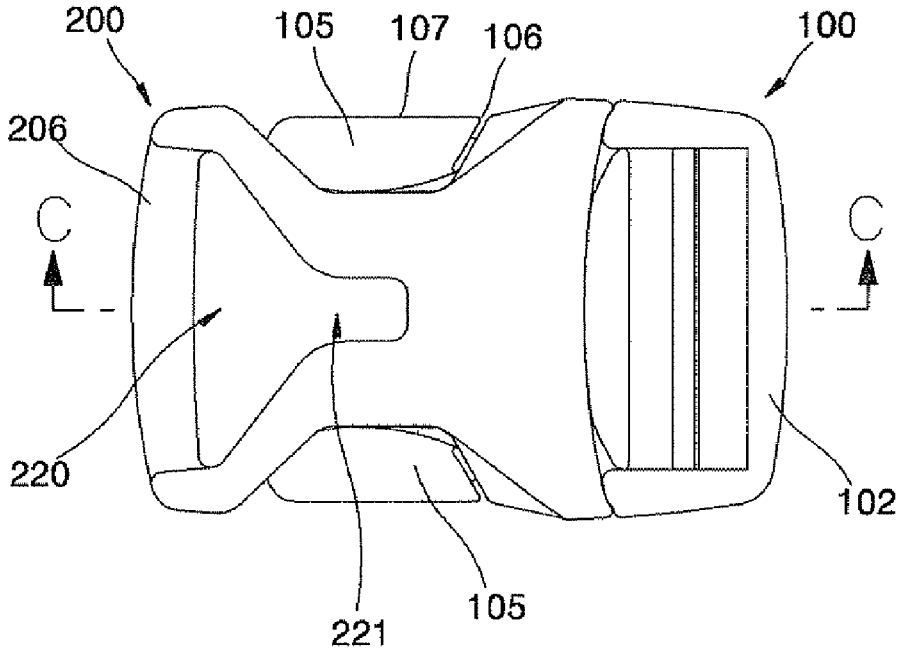
FIG. 8 is a plan view illustrating the assembled state of the buckle in accordance with the embodiment of the present invention.
Figure 9:
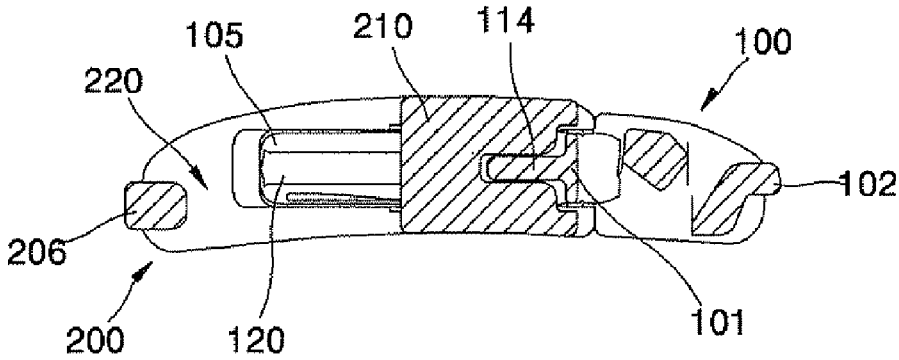
FIG. 9 is a sectional view taken along the line C-C of FIG. 8.

FIG. 2 is an exploded perspective view illustrating a buckle in accordance with an embodiment of the present invention, FIG. 3 is an assembled perspective view of the buckle shown in FIG. 2, FIGS. 4 and 6 are plan views illustrating a plug member and a socket member in accordance with the embodiment of the present invention, and FIGS. 5 and 7 are sectional views of FIGS. 4 and 6. FIG. 8 is a plan view illustrating the assembled state of the buckle in accordance with the embodiment of the present invention, and FIG. 9 is a sectional view taken along the line C-C of FIG. 8.

Referring to FIGS. 2 through 9, a buckle in accordance with an embodiment of the present invention generally includes a plug member 100 and a socket member 200 which are detachably coupled to each other. The plug member 100 and the socket member 200 are usually formed of synthetic resin and are used in a state in which they are respectively connected to the free ends of straps S1 and S2.

A base part 101 is formed in the middle of the plug member 100, and a strap connector is formed behind the base part 101. The strap connector has a cross bar 102 which is formed parallel to the base part 101 so that the free end of the strap S1 can be wound thereon. A space part is defined between the base part 101 and the cross bar 102. A strap hooking bar 103 is formed across the space part parallel to the base part 101 and the cross bar 102 so that the strap S1 can be wound on the cross bar 102 and the strap hooking bar 103 in opposite directions so as to be adjusted in the length thereof as the occasion demands. Alternatively, the strap connector can have only the cross bar 102 so that the free end of the strap S1 can be fixed through stitching after it is wound on the cross bar 102.

A pair of lock arms 105 are formed parallel to each other on both ends of the base part 101 to extend forward from the base part 101 in a direction opposite to a direction in which the strap connector is formed.

The lock arms 105 are symmetrical with respect to the center portion of the base part 101 of the plug member 100. The lock arms 105, which extend from the base part 101, have a small thickness so that they can be elastically bent. The distal end portions of the lock arms 105 have a shape which is enlarged. Engagement shoulders 106 are formed at the middle portions of the pair of lock arms 105 to project outward. Pressing parts 107 to be used for decoupling the buckle are formed on the outer surfaces of the lock arms 105 to extend from the engagement shoulders 106 to the distal ends of the pair of lock arms 105. Therefore, the lock arms 105 are divided into proximal portions which are thin to have elasticity and the distal portions which are enlarged, and the engagement shoulders 106 are formed between these two portions.

A guide rod 110 is formed between the pair of lock arms 105 on the plug member 100 to extend forward from the base part 101. The guide rod 110 is formed to have a length shorter than the lock arms 105. The guide rod 110 extends approximately to the lengthwise middle of the lock arms 105. Due to this fact, the elasticity level of the lock arms 105 can be secured so that, when a user presses the pressing parts 107 of the pair of lock arms 105 using fingers, the pair of lock arms 105 can be sufficiently bent inward.

A slot 111 is defined in the guide rod 110. A pair of guide walls 112 are formed on both sides of the slot 111 to face each other. Ribs 113 are formed on the outer surfaces of the guide walls 112 and are supported by the base part 101. The slot 111 is defined to extend from the distal end of the guide rod 110 to the lengthwise middle of the guide rod 110. A connecting part 114 is formed from the middle portion of the guide rod 110 to the base part 101 so as to sufficiently reinforce the strength of the guide rod 110.

Bridges 120 are integrally formed on the base part 101 of the plug member 100 in such a way as to be connected with the lock arms 105. The bridges 120 are formed of a flexible material and have a predetermined level of elasticity. Both ends of the bridges 120 are connected to the base part 101 and the distal end portions of the inner surfaces of the lock arms 105.

The bridges 120 extend from the base part 101 and are connected to predetermined portions of the inner surfaces of the lock arms 105. The bridges 120 can be selected to be connected to portions of the lock arms 105 which are placed between the middle portions and the distal ends of the lock arms 105. As the bridges 120 are connected to the inner surfaces of the lock arms 105 at positions that are distant from the base part 101, the elasticity of the bridges 120 is increased. Thus, it is preferred that the bridges 120 extend from one end of the base part 101 inside the lock arms 105 and be connected to the distal ends of the inner surfaces of the lock arms 105.

The bridges 120 are formed to be thin and extend parallel to the lock arms 105. At least one bending portion 121 is formed on the intermediate portion of each bridge 120. Due to the presence of the bending portion 121, the elastic force of the bridge 120 can be increased. Alternatively, the bridges 120 can be formed to have curved surfaces.

While the bridges 120 are formed inside the lock arms 105 in this way, since the guide rod 110 is formed to have a length shorter than the lock arms 105, when the lock arms 105 are bent, interference between the bridges 120 and the guide rod 110 is avoided.

The socket member 200 has an upper plate 201 and a lower plate 202 which face each other. The side edges of the upper plate 201 and the lower plate 202 are connected by sidewalls 203, as a result of which a chamber 205 for guiding and receiving the plug member 100 is defined in the socket member 200. A cross bar 206 for fixing the free end of the other strap S2 is formed at the rear end of the socket member 200 to extend in the transverse direction. Similar to the plug member 100, a strap hooking bar can be formed on the socket member 200 so that the length of the strap S2 can be adjusted as the occasion demands.

If the plug member 100 is completely coupled to the socket member 200 by being fitted into the chamber 205 of the socket member 200, the base part 101 of the plug member 100 is positioned at the entrance of the chamber 205. A guide rib 210 for guiding the guide rod 110 is formed in the widthwise middle of the chamber 205 in such a way as to connect the upper plate 201 and the lower plate 202 of the socket member 200. The guide rib 210 functions to maintain the chamber 205 of the socket member 200 by itself and guide the guide rod 110 of the plug member 100.

The guide rib 210 is fitted into the slot 111 of the guide rod 110 when the plug member 100 and the socket member 200 are coupled to each other. The fitting of the guide rib 210 into the slot 111 of the guide rod 110 ensures that, after the plug member 100 and the socket member 200 are coupled to each other, the coupled state is stably maintained against fluctuation.

When the guide rib 210 is fitted into the slot 111 of the guide rod 110, in order to prevent interference between the connecting part 114 of the guide rod 110 and the guide rib 210, a groove 211 is defined in the guide rib 210 at a position where the connecting part 114 of the guide rod 110 is inserted into the guide rib 210.

The entrance of the chamber 205 of the socket member 200 has a width that substantially corresponds to a width between the outer surfaces of the lock arms 105 of the plug member 100. The chamber 205 is defined such that the width between the sidewalls of the chamber 205 gradually decreases inward from the entrance. Hence, when the plug member 100 is fitted into the chamber 205, the lock arms 105 are inserted while being pressed inward by the sidewalls of the chamber 205 which define the gradually decreasing width so that the lock arms 105 can retain sufficient elasticity.

Openings 215 are defined through both sidewalls of the socket member 200 to communicate with the chamber 205 such that the distal end portions, that is, the pressing parts 107 of the lock arms 105 are exposed through the openings 215 when the plug member 100 and the socket member 200 are coupled to each other. While the pressing parts 107 are inserted inward into the chamber 205 by being pressed inward by the sidewalls of the chamber 205, when the pressing parts 107 are aligned with the openings 215, the pressing parts 107 elastically project outward through the openings 215. At this time, one edges of the openings 215 serve as engagement parts 216. As the engagement shoulders 106 of the lock arms 105 are engaged with the engagement parts 216, the coupled state of the plug member 100 and the socket member 200 can be maintained as it is.

The openings 215 are defined to encroach on some portions of the upper plate 201 and the lower plate 202 so that spaces for pressing the pressing parts 107 of the lock arms 105 when decoupling the plug member 100 from the socket member 200 can be secured.

A pattern in which the openings 215 encroach on the upper plate 201 and the lower plate 202 is set to become gradually narrow, so that, when decoupling the plug member 100 from the socket member 200, manipulation for moving the lock arms 105 out of the socket member 200 can be simultaneously implemented by pressing the pressing parts 107 of the lock arms 105.

A space part 220 is defined between the body of the socket member 200 and the cross bar 206 which is formed at the rear end of the socket member 200 so that the strap S2 can be wounded on the cross bar 206. In the socket member 200 according to the present invention, the space part 220 is defined in such a way as to be expanded toward the center portion of the socket member 200.

Indents 221 are symmetrically defined in the upper plate 201 and the lower plate 202 from the space part 220 toward the center portion of the socket member 200 so that the space part 220 can be expanded. Therefore, substantial portions of the upper plate 201 and the lower plate 202 of the socket member 200 are open rearward.

The indents 221 have a sectional shape which is gradually narrow from the space part 220 toward the center portion of the socket member 200. When the plug member 100 is coupled to the socket member 200, the distal end of the guide rod 110 is flush with the rear end of the guide rib 210. In this regard, it is preferred that the indents 221 be defined to reach the rear end of the guide rib 210.

Accordingly, since the socket member 200 has a great amount of spaces except the portions necessary for coupling with the plug member 100, the probability of foreign substances to remain in the chamber 205 can be minimized.

Referring to the drawings, each of the indents 221 successively forms an inclined section which gradually decreases in width from the space part 220 toward the center portion of the socket member 200 and a straight section which is formed to the rear end of the guide rib 210. The indents 221 can be formed to have the sectional shape of a 'V', 'Y' or 'U', while not being limited to such.

As a result, the chamber 205 of the socket member 200 is defined in a manner such that the entrance of the chamber 205, the openings 215 on both sides and the indents 221 on the rear part communicate with one another in a close positional relationship.

Operation of the buckle according to the present invention, constructed as mentioned above, will be described below.

As the lock arms 105 of the plug member 100 are inserted into the chamber 205 of the socket member 200, the lock arms 105 are pressed inward in the chamber 205 since both sidewalls of the chamber 205 are formed to have the gradually decreasing width. Then, when the lock arms 105 reach the positions of the openings 215, the lock arms 105 are elastically biased outward, and the pressing parts 107 of the lock arms 105 project through the openings 215.

The pressing parts 107 of the lock arms 105 which project through the openings 215 are held in a fixed state without fluctuation because the engagement shoulders 106 of the plug member 100 are engaged with the engagement parts 216 of the socket member 200.

When the plug member 100 is moved in the chamber 205 of the socket member 200 as described above, as the slot 111 of the guide rod 110 is guided by the guide rib 210 of the socket member 200, stable sliding is implemented. With the plug member 100 and the socket member 200 completely coupled to each other, the guide rib 210 is positioned in the slot 111, and the distal end of the guide rod 110 is flush with or reaches adjacently the inner ends of the indents 221 of the socket member 200.

When decoupling the plug member 100 from the socket member 200, by pressing the pressing parts 107 of the lock arms 105 inwards from outsides through the openings 215, the engagement shoulders 106 of the lock arms 105 are disengaged from the engagement parts 216 of the socket member 200, and the pressing parts 107 of the lock arms 105 are brought into contact with the inner surfaces of the sidewalls of the chamber 205. In this state, the outer surfaces of the lock arms 105 are actually inclined with respect to the center line of the plug member 100 and the inner surfaces of the sidewalls of the chamber 205 are formed to have the gradually decreasing width in the rearward direction, the lock arms 105 are applied with force due to their elasticity to be removed out of the chamber 205. According to this fact, the plug member 100 can be smoothly decoupled out of the chamber 205 of the socket member 200.

Therefore, when the plug member 100 and the socket member 200 are coupled to and decoupled from each other, the lock arms 105 are elastically engaged and disengaged by their elasticity. As the elastic force of the bridges 120 is additionally applied to the lock arms 105, the lock arms 105 can have sufficient strength and elasticity. Therefore, even when the lock arms 105 are inadvertently or unintentionally applied with excessive outward pressure, the deformation or breakage of the lock arms 105 can be prevented due to reinforcement by the bridges 120, whereby the stable state of the lock arms 105 can be maintained.

As is apparent from the above description, in the buckle according to the present invention, due to the fact that bridges are formed to extend in the same direction as lock arms, it is possible to prevent the lock arms from being deformed or broken due to excessive outward bending and maintain the sufficient elasticity of the lock arms so that a plug member and a socket member can be easily coupled to and decoupled from each other.

Also, in the present invention, it is possible to prevent foreign substances from being easily attached therein and easily remove foreign substances introduced therein.

Further, in the present invention, it is possible to save a material so that the manufacturing cost can be reduced and decrease the weight of the buckle so that a knapsack, a bag, etc. can be used lightly, while preventing the lock arms from being deformed or broken due to excessive outward bending.

Although a preferred embodiment of the present invention has been described for illustrative purposes, those skilled in the art will appreciate that various modifications, additions and substitutions are possible, without departing from the scope and the spirit of the invention as disclosed in the accompanying claims. For example, the lengths and the coupled state of the guide rod 110 and the guide rib 210 can be appropriately changed as the occasion demands, and the shapes of the bridges 120 and the recessed parts 221 can be optionally changed in the designs thereof without limit.

What is claimed is:

1. A buckle having a plug member and a socket member which are detachably coupled to each other, wherein the plug member having a base part, a pair of lock arms which project from the base part to be elastically coupled to the socket member, a guide rod which projects from the base part between the pair of lock arms, and bridges which extend from the base part inside the pair of lock arms and are connected to distal ends or middle portions of inner surfaces of the lock arms, and wherein the socket member have a chamber which is defined by an upper plate, a lower plate and sidewalls connecting the upper and lower plates and is open at a distal end thereof to receive the pair of lock arms and the guide rod, and engagement parts which are formed outside the chamber to allow distal end portions of the lock arms to be engaged therewith, wherein a slot is defined in the guide rod in a lengthwise direction of the guide rod, and a guide rib to be fitted into the slot of the guide rod is formed in the chamber of the socket member in such a way as to connect the upper and lower plates, wherein the slot is defined to a middle portion of the guide rod, a connecting part is formed to extend from the middle portion of the guide rod to the base part, and a rib groove is defined in the guide rib to receive the connecting part.

2. The buckle according to claim 1, wherein each bridge is formed with one or at least two bending portions on an intermediate portion thereof.

3. The buckle according to claim 1, wherein each bridge is formed in such a way as to define a curved surface.

4. The buckle according to claim 1, wherein each bridge is formed of a flexible material.

5. The buckle according to claim 1, wherein the guide rod of the plug member is formed between the lock arms to be shorter than the lock arms.

6. The buckle according to claim 1, wherein openings are defined on the sidewalls of the socket member which connect the upper and lower plates such that the engagement parts are formed through molding and outer surfaces of the distal end portions of the lock arms are exposed through the openings.

7. The buckle according to claim 1, wherein a space part is defined in a rear part of the socket member to communicate with the chamber defined in the socket member and has indents which are defined in the upper and lower plates so that the space part can be enlarged forward into the socket member.

8. The buckle according to claim 7, wherein the indents are defined to have the sectional shape of a 'V' which gradually decreases in a width thereof toward a center portion of the socket member.

9. The buckle according to claim 7, wherein the indents are defined to have the sectional shape of a 'Y' which gradually decreases in a width thereof toward a center portion of the socket member.

10. The buckle according to claim 1, wherein the guide rod of the plug member extends from the base part to be shorter than the lock arms, a slot is defined from a distal end of the guide rod in the lengthwise direction of the guide rod, a guide rib to be fitted into the slot of the guide rod is formed in the chamber of the socket member in such a way as to connect the upper and lower plates, and a space part is defined in a rear part of the socket member to communicate with the chamber and has indents which are defined in the upper and lower plates so that the space part can be enlarged forward to a portion where the distal end of the guide rod is positioned when the plug member is coupled to the socket member.

11. The buckle according to claim 10, wherein each of the indents forms an inclined section which gradually decreases in width from the space part and a straight section which is formed from a middle portion of the indent.

* * * * *